United States Patent [19]

Richardson et al.

[11] Patent Number: 4,762,435

[45] Date of Patent: Aug. 9, 1988

[54] LETTERING APPARATUS HAVING A PRINTER-KEYBOARD INTERFACE

[75] Inventors: Michael M. Richardson, Scottsdale; Joseph M. Sega, Phoenix, both of Ariz.; Ronald F. Tuckner, White Bear Lake, Minn.

[73] Assignee: Kroy Inc., Scottsdale, Ariz.

[21] Appl. No.: 884,424

[22] Filed: Jul. 11, 1986

Related U.S. Application Data

[63] Continuation of Ser. No. 667,908, Nov. 2, 1984, abandoned.

[51] Int. Cl.[4] ..... B41J 19/32

[52] U.S. Cl. ..... 400/304; 400/130; 400/154.5; 400/479

[58] Field of Search ..... 400/48, 103, 158, 134.1, 400/130, 154.5, 479, 127, 134, 134.4, 129, 134.5, 131, 304

[56] References Cited

U.S. PATENT DOCUMENTS

| | | | |
|---|---|---|---|
| 1,767,247 | 6/1930 | Kurowski et al. | 400/131 X |
| 2,680,507 | 6/1954 | Frey et al. | 400/131 X |
| 3,203,528 | 8/1965 | Bogeaus | 400/131 X |
| 3,243,031 | 3/1966 | Przysiecki | 400/130 X |
| 3,282,839 | 11/1966 | Rudisch et al. | 400/134.1 X |
| 3,785,470 | 1/1974 | Schacht | 400/134.1 X |
| 4,214,520 | 7/1980 | Eissel | 400/134.1 X |
| 4,384,711 | 5/1983 | Gabel et al. | 400/130 X |
| 4,462,708 | 7/1984 | Luartes et al. | 400/479 X |

FOREIGN PATENT DOCUMENTS

| | | | |
|---|---|---|---|
| 1007781 | 5/1957 | Fed. Rep. of Germany | 400/134 |

*Primary Examiner*—Edgar S. Burr
*Assistant Examiner*—James R. McDaniel
*Attorney, Agent, or Firm*—Dorsey & Whitney

[57] ABSTRACT

A lettering apparatus having an improved interface feature including a printer portion, a data input portion and an interface assembly for connecting the printer with the keyboard comprising an electrical interface, a font motor interface and an initial alignment interface. The interface assembly facilitates quick, uncomplicated and inexpensive conversion of a manual lettering system to an automated lettering system.

14 Claims, 4 Drawing Sheets

LETTERING APPARATUS HAVING A PRINTER-KEYBOARD INTERFACE

This application is a continuation of application Ser. No. 667,908, filed 11/02/84 which is abandoned.

BACKGROUND OF THE INVENTION

The present invention relates generally to a lettering apparatus or lettering system and more particularly to a lettering apparatus having an improved means for interfacing the printer and the keyboard.

Various forms of lettering apparatus currently exist in the prior art. Many of these are dry lettering type apparatus to which the present invention is particularly applicable. A typical lettering apparatus of this type is described in U.S. Pat. No. 4,243,333 dated Jan. 6, 1981. In general, such an apparatus includes a lettering station, a means for supplying a printing tape and a printing ribbon at the printing station, a rotatable font for positioning a character in alignment at the print station and a force generation means. The force generation means creates a printing force at the printing station to transfer an image of the aligned character from the printing ribbon to the printing tape. Initially these lettering apparatus were manually operated and required the manual rotation of the character font or disk to position a desired character in alignment at the printing station.

Subsequently, the manual lettering apparatus was automated by adding a keyboard or other data input means and a motor for automatically rotating the character font to the proper character. An example of such an automated lettering apparatus is described in U.S. Pat. No. 4,462,708 issued July 31, 1984. Various attempts have also been made to automate existing manual lettering apparatus by retrofitting the same with a keyboard or other similar data input means.

Although many of the presently existing automated lettering apparatus function satisfactorily in many respects there are several ways in which they can be improved. For example, the apparatus currently available are either wholly contained within a single housing, and therefore not retrofittable, or are capable of being retrofitted. For those intended for retrofitting, the retrofitting process is quite complicated and expensive and requires a significant level of expertise. Because of this, the current system tend to discourage the automation of a previously purchased manual lettering apparatus or tend to discourage a purchaser from initially acquiring a manual system with the intent of acquiring an automated attachment when such a feature is needed or desired. Thus, there is a need in the art of lettering apparatus for a system which permits quick, uncomplicated and inexpensive conversion from a manual lettering system to an automated lettering system.

SUMMARY OF THE INVENTION

The present invention relates to a lettering apparatus having an improved system for interfacing the printer and keyboard portions. With the system of the present invention, a purchaser can acquire the printer portion of the apparatus and operate the same manually in the manner intended. If, at some future date, he wishes to automate the previously acquired manual printer, he merely purchases the keyboard or automated portion of the system and interfaces it directly with the previously acquired manual printer. The interface system of the present invention permits the user to interface the two portions by merely placing the printer on top of the keyboard portion in a designated alignment position. Because of the existence of various interface elements, the cooperating electrical and mechanical interface components are automatically aligned and interfaced with one another in an operational position.

More specifically, the present invention includes an interface means for providing correct initial positioning of the printer with respect to the keyboard, motor interface means facilitating proper interface between the character font motor located in the keyboard housing and the character font and electrical interface means facilitating the electrical connection between corresponding leads in the keyboard and the printer. In the preferred embodiment, the motor interface means includes a floating alignment element connected with either the keyboard or the printer and a cooperating fixed alignment member connected with the other. Similarly, the electrical interface means includes a floating electrical interface element connected with either the keyboard or the printer and a cooperating fixed electrical interface element connected with the other. The positioning interface elements includes a plurality of interface cavities formed in the mating surface of either the keyboard or the printer and a similar number of alignment prongs connected with the other. With the above alignment means, the printer portion of the automated lettering apparatus is automatically interfaced with the keyboard portion merely by properly placing the printer on top of the keyboard.

Accordingly, it is an object of the present invention to provide a lettering apparatus having an improved interface system between a printer and a keyboard.

Another object of the present invention is to provide an improved lettering apparatus which eliminates the complicated and expensive retrofit mechanisms of the prior art.

A further object of the present invention is to provide an improved lettering system which permits a purchaser to initially acquire a manually operable lettering system and then, when needed or desired, supplement the same with a keyboard which is easily interfaced with the originally purchased manual system.

These and other objects of the present invention will become apparent with reference to the drawings, the description of the preferred embodiment and the appended claims.

DESCRIPTION OF THE PREFERRED EMBODIMENT

Figure 1:
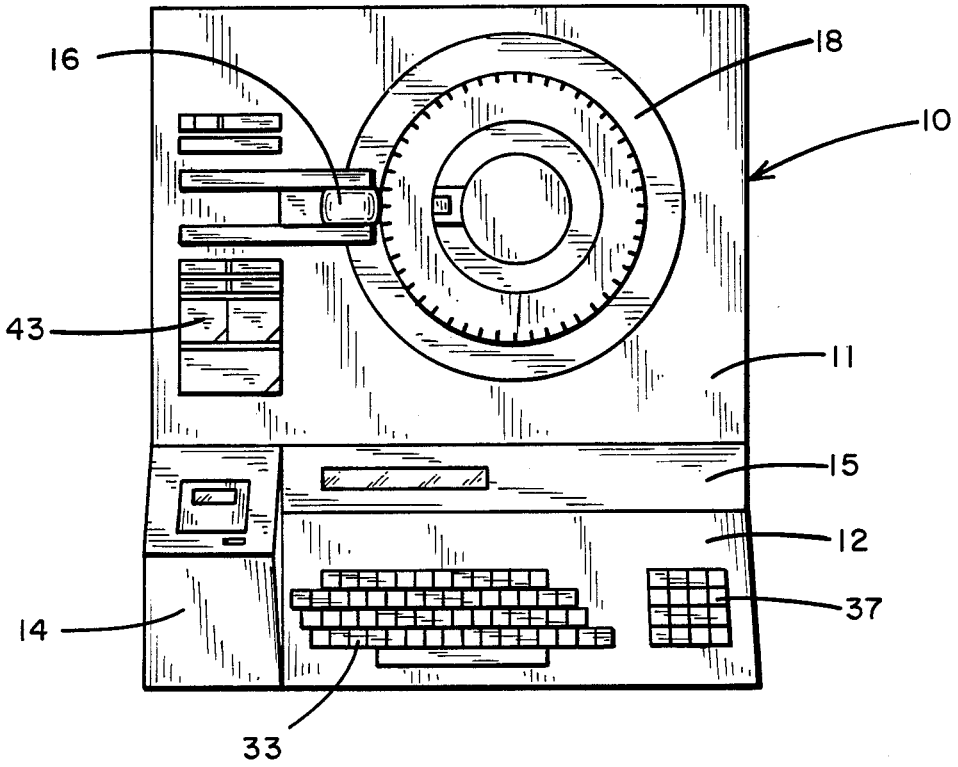
FIG. 1 is an elevational top view of an automated lettering apparatus embodying the printer-keyboard interface features of the present invention.
Figure 2:
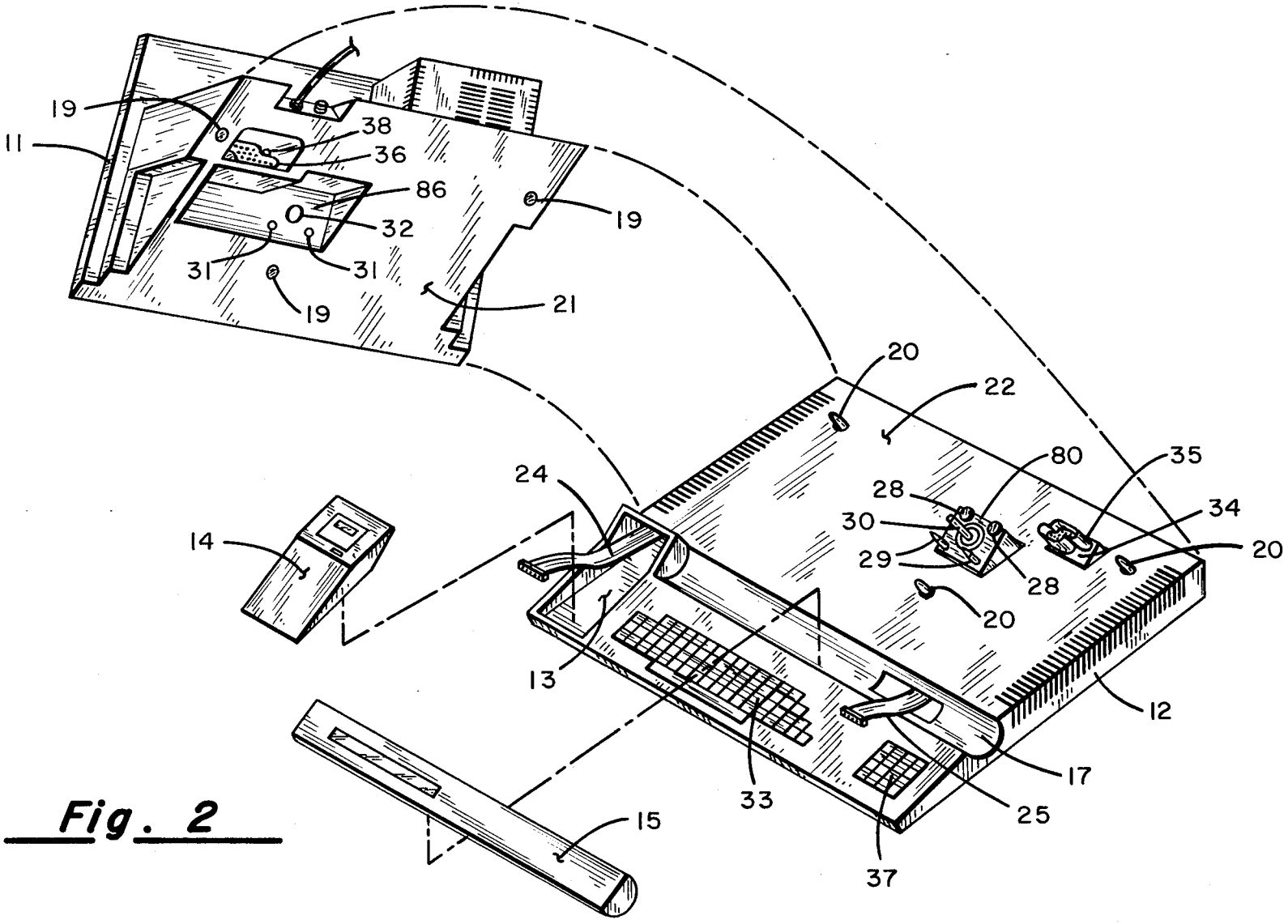
FIG. 2 is a pictorial, broken-apart view of the lettering apparatus of FIG. 1 showing the printer, the display module and the cassette module removed from the keyboard.

Reference is first made to FIGS. 1 and 2 showing the lettering apparatus 10 of the present invention. In FIG. 1, the lettering apparatus 10 is shown with the printer portion 11 interfaced with the keyboard 12, whereas in FIG. 2, the printer 11 is removed from the keyboard 12 to show the various interface assemblies. Although it is contemplated that the various interface assemblies embodied in the present invention can be utilized in a variety of printing apparatus, it has particular applicability to a dry lettering printing apparatus of the type having a rotatable font or character disk 18 and a force generation means 16 to transfer an image of a character on the font 18 from a printing ribbon to a printing tape. When the printer 11 of the lettering apparatus 10 is used separately, the character font 18 is manually rotatated. When the printer 11 is combined with the keyboard portion 12 utilizing the interface means of the present invention, the character font 18 is automatically rotated by a motor which is housed in the keyboard 12.

The bottom of the printer 11 is provided with a mounting or interface surface 21 and the top of the keyboard 12 is provided with a corresponding mounting or interface surface 22. When the printer 11 is used manually, the surface 21 is placed directly onto a table or other supporting surface. When the system is automated, the surfaces 21 and 22 are placed in face-to-face engagement with each other.

In addition to the printer 11 and the keyboard 12, the lettering apparatus 10 includes several additional modular components. Included among these are a display and editing module 15 and a digital cassette drive 14. As illustrated, the display and editing module 15 is adapted for connection with the keyboard 12 within the mounting cavity 17. The display module 15 is electrically connected with the keyboard 12 via the display module cable 25. The display and editing module 15 permits the user to view the data which has been typed into the keyboard and also to make changes to or edit such data prior to activating the print cycle.

The digital cassette drive module 14 is mounted within the cassette drive mounting cavity 13 in the keyboard 12 and is electrically connected with the keyboard 12 via the cassette drive cable 24. The module 14 permits the lettering apparatus 10 to operate from instructions contained on various cassette tapes inserted into the cassette drive module 14.

The keyboard 12 includes a main keyboard 33 having a plurality of character and other keys which are arranged similar to a standard typewriter. The keyboard portion 12 also includes a function keypad 37 comprising a plurality of function keys to facilitate operation of the automated lettering system. The printer 11 includes a control panel 43 comprising a plurality of control buttons to control operation of the printer 11. These have particular applicability when the printer 11 is used manually.

When the printer 11 is used manually, it is a standalone item which exists and operates independently of the keyboard 12. The printer 11 includes a print cycle motor (not shown) and the various other mechanisms needed to function as a manual printer. This permits a purchaser to acquire the printer portion 11 and to operate the same independently from the keyboard 12 in a manual mode. If, at some later time, the user needs or desired to automate his lettering system, he acquires the keyboard portion 12 and interfaces it with the printer 11.

The lettering apparatus 10 illustrated in FIGS. 1 and 2 comprises three principal interface assemblies to permit quick, easy and uncomplicated interface between the printer 11 and the keyboard 12. These interface assemblies include an electrical interface (illustrated best in FIGS. 2, 3, 4 and 5), a stepper motor or font motor interface (illustrated best in FIGS. 2 and 6) and a positioning interface (illustrated best in FIGS. 2 and 7).

With reference to FIGS. 2–5, the electrical interface assembly includes a mounting base 34 which is securely fixed with respect to an electrical connector housing 53 extending outwardly and upwardly from the top surface 22. As illustrated best in FIG. 2, the housing 53 and therefore the mounting base 34 is disposed so that an upper mounting surface of the member 34 facing upwardly and forwardly relative to the upper surface 22 of the keyboard 12. The member 34 is secured to the surface 22 by a pair of screws 49 or other similar connecting members. Joined with the mounting member 34 and extending upwardly therefrom is an interface socket 35. The socket 35 comprises an upwardly extending wall portion defining an interface cavity or recessed portion 47. Positioned at each end of this portion 47 is an alignment cavity 39 which is adapted for engagement with corresponding interface or alignment prongs 38 as will be described below. Positioned within the recessed portion 47 is an electrical receptacle having a plurality of individual connector receptacles 41.

Figure 4:
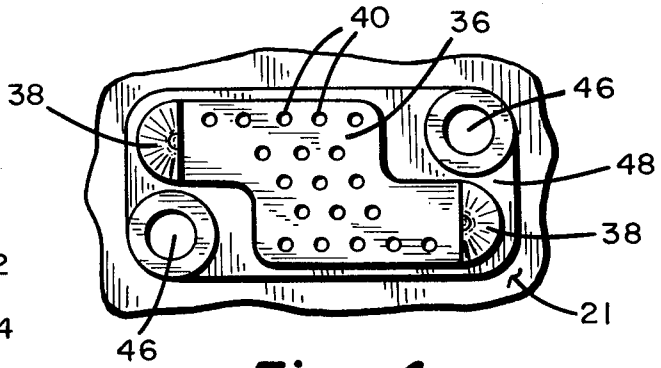
FIG. 4 is an elevational view of one of the electrical interface elements as viewed along the line 4—4 of FIG. 3.
Figure 5:
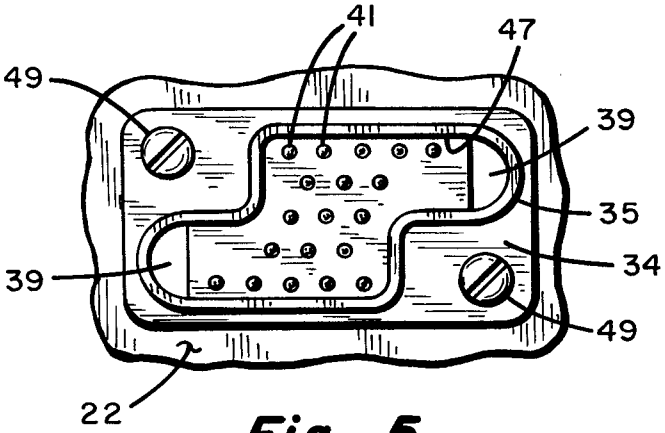
FIG. 5 is an elevational view of the other of the electrical interface elements as viewed along the line 5—5 of FIG. 3.
Figure 3:
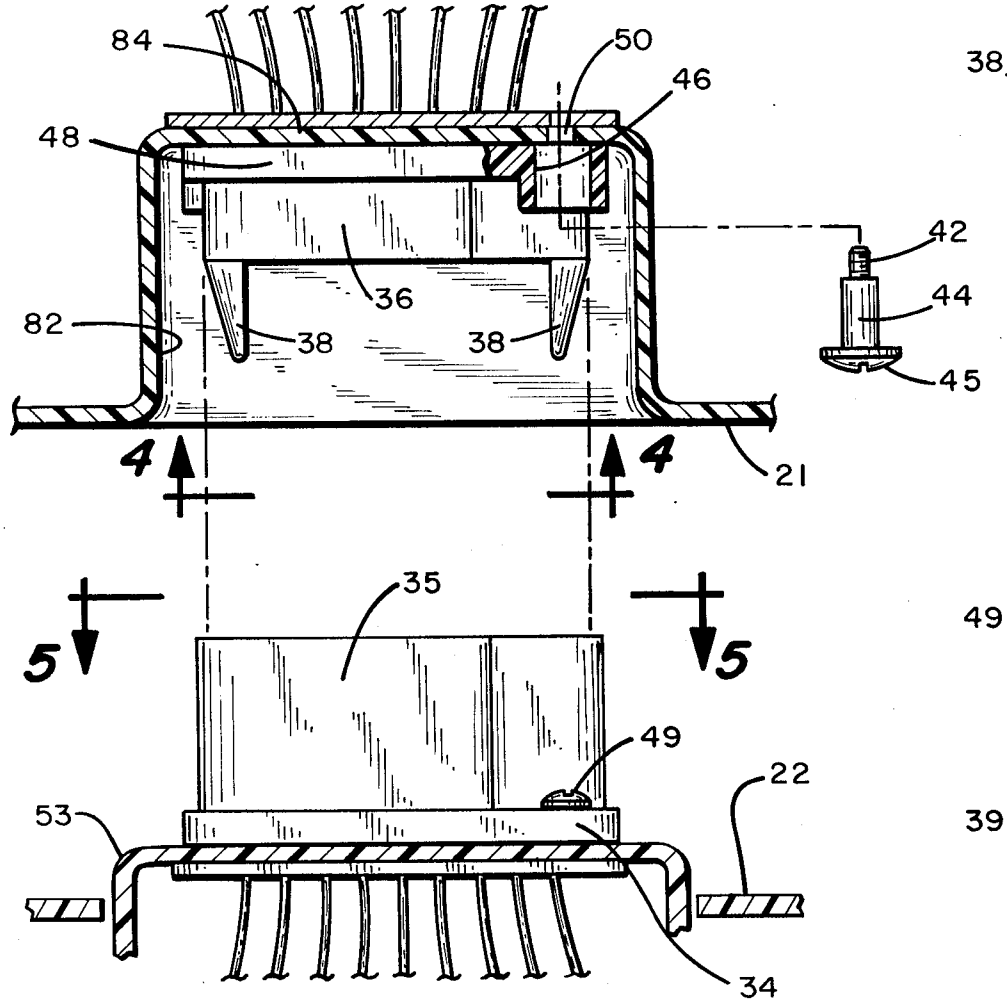
FIG. 3 is a view, partially in section, showing the two interface elements of the electrical interface means separated from one another and in position for engagement.

The electrical interface means also includes a cooperating interface element 36 extending outwardly from a mounting base 48 for insertion into and engagement with the cavity 47 defined by the sidewalls of the member 35. The mounting base 48 is connected with a mounting wall 84 formed in a recessed area 82 of the surface 21. As illustrated in FIGS. 3 and 4, the base 48 is connected to the wall 84 by a pair of threaded members extending through corresponding openings 46 in the member 48 and then threadedly received by threaded openings 50 in the wall 84. The threaded member includes an enlarged head portion 45, a generally cylindrical intermediate portion 44 and a lower threaded portion 42. It should be noted that the intermediate portion 44 of the threaded member is smaller in diameter than the cylindrical opening 46 in the member 48 and that the length of the intermediate portion 44 is greater than the length of the opening 46. This facilitates limited movement of the member 48, and thus the interface member 36, relative to the surface 21 of the printer. In the preferred embodiment, the respective diameters of the intermediate portion 44 and the opening 46 are sufficient to permit limited movement of the member 48 of approximately four millimeters.

The interface portion 36 extends outwardly from the mounting member 48 and has an outer configuration and size approximating that of the cavity 47 defined by the member 35. The outermost surface of the interface member 36 includes a plurality of electrical connector members 40 which are adapted for electrical connection with the corresponding receptacles 41. Extending outwardly from the outer surface of the member 36 are a pair of alignment prongs 38 for corresponding engagement with the alignment cavities 39. As shown best in FIG. 3, these alignment prongs 38 are tapered to permit the same to be self-aligning with respect to the cavities 39. Thus, if the mounting members 36 and 34 are not initially aligned, the limited movability of the member 48 in conjunction with the tapered prongs 38 permits proper alignment and engagement between the members 35 and 36 and between the prongs 38 and the cavities 39. When fully engaged, the electrical members 40 are engaged with the electrical receptors 41 to provide electrical connection between the keyboard and the printer.

It should be noted that the inner mounting wall 84 is sloped with respect to the surface 21 so that the member 36 extends downwardly and rearwardly to mate with the upwardly and forwardly extending member 35. In the preferred embodiment, the angles which the members 36 and 35 form with the lower surface 21 of the printer and the upper surface 22 of the keyboard, respectively, are equal to permit the above described interface engagement.

Figure 6:
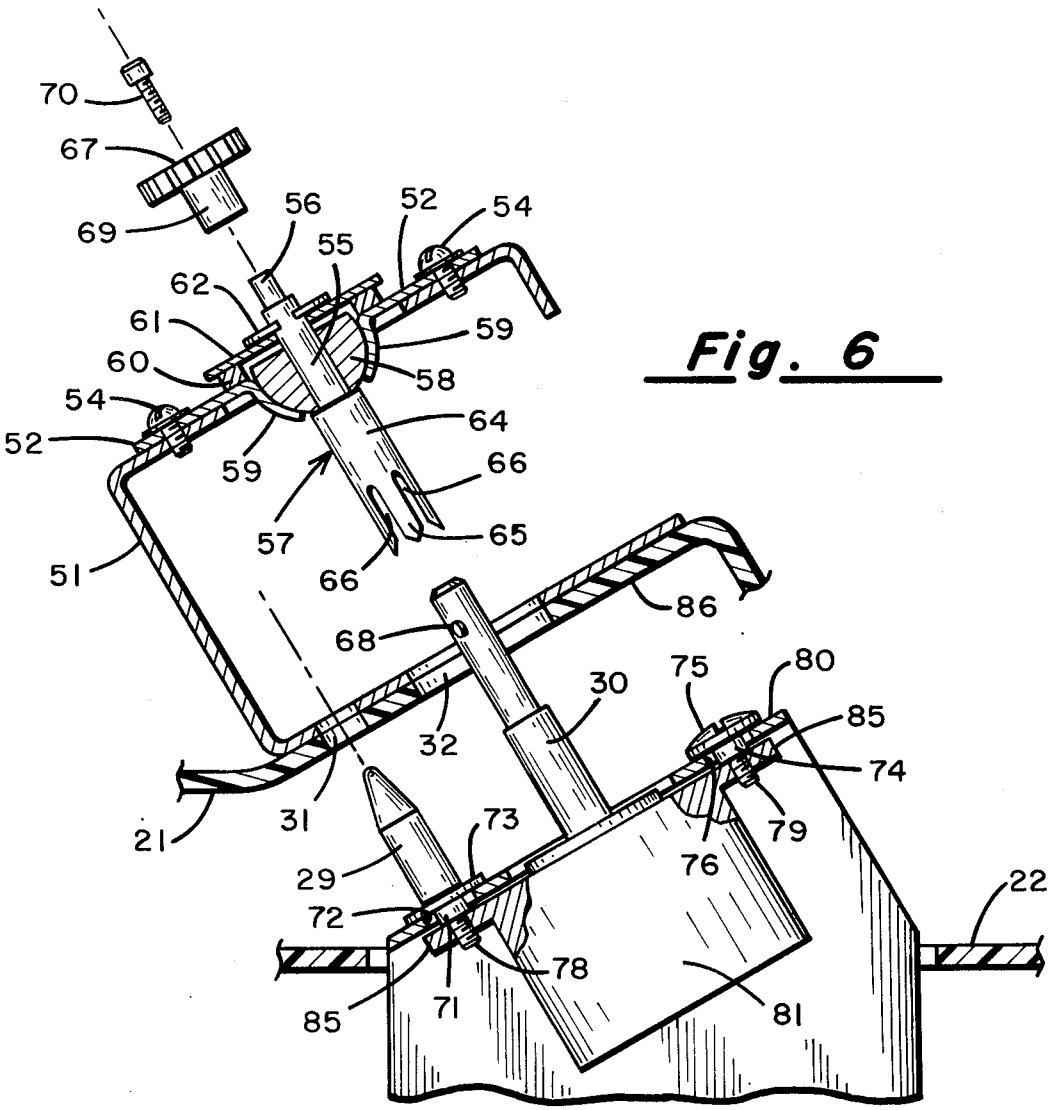
FIG. 6 is a view, partially in section, showing the character font motor interface means.

The font motor interface means is illustrated best in FIGS. 2 and 6. This means includes a housing 80 securely connected with the main frame of the keyboard. This housing 80 extends upwardly from the surface 22 and includes an upwardly facing mounting surface which is disposed at an angle with respect to the upper surface 22. This surface faces upwardly and forwardly in a plane generally parallel to the mounting surface of the member 34.

Mounted to the housing 80 is a font motor housing 81 which houses a stepper motor for driving the character font 18 (FIG. 1). The motor housing 81 includes a plurality of outwardly extending flange portions 85 which include openings to receive threaded members. Specifically, two of the threaded members are screws 28 having an enlarged head portion 75, an intermediate shank portion 74 and a lower threaded portion 79. The other two threaded members are outwardly extending alignment pins 29. The lower end of each of these pins 29 includes an enlarged flange 73, a cylindrical intermediate portion 71 and a lower threaded portion 78. The upper end of each of the alignment pins is tapered. The screws 28 and the alignment members 29 extend through corresponding openings 72 and 76 in the upper surface of the housing 80 and are then threadedly received by the outer flanges 85 of the motor housing 81. It should be noted that the openings 72 and 76 in the housing 80 are larger in diameter than the intermediate portions 71 and 74. This difference in size permits limited movement of the motor housing 81 relative to the mounting surface 22 of the keyboard. In the preferred embodiment, the difference in dimensions between the holes 72 and 76 and the corresponding portions 71 and 74 is sufficient to permit limited movement of the housing 81 of approximately six millimeters.

Extending outwardly from the motor housing 81 is an output shaft 30. In the preferred embodiment, the shaft 30 extends outwardly from the housing 81 in a direction generally parallel to the alignment members 29.

Formed within the lower surface 21 of the printer is a font motor mounting cavity having a mounting surface 86. The mounting surface 86 includes a motor shaft opening 32 and a pair of alignment openings or cavities 31, 31. When the printer and keyboard are interfaced, the mounting surface 86 is disposed in a plane generally parallel to the mounting surface of the housing 80. The pair of alignment openings 31, 31 are adapted for engagement by the corresponding alignment pins 29, 29. The shaft 30 is adapted for extension through the opening 32 and engagement with a font motor or motion transfer shaft 57 for driving the character font 18 (FIG. 1).

Positioned above and connected with the surface 86 is a font shaft housing 51 for housing the motion transfer shaft 57. The transfer shaft 57 extends between the output shaft 30 and the character font. Connected with an upper surface of the housing 51 is a bearing housing 52 having a bearing receiving cavity 59 to receive a portion of the bearing member 58. The bearing 58 is connected to the shaft 57 via an intermediate portion 55. The lower end of the shaft 57 includes a hub 64 having a plurality of alternating prongs 65 and grooves 66 for engagement with the upper end of the output shaft 30. The shaft 30 includes a protruding tab 68 extending into one of the grooves 66 between adjacent prongs 65 to transfer rotational movement of the shaft 30 to the shaft 57. The lower ends of the prongs 65 are beveled to assist in guiding the protruding member 68 into the grooves 66.

The upper end 56 of the shaft 57 comprises a cylindrical portion to which the gear member 69 is connected. The gear 69 is connected with the portion 56 by a threaded member 70 extending into a threaded opening within the member 56. The gear 69 includes a plurality of gear teeth 67 for engagement with corresponding gear teeth on an inner peripheral ring of the character font. A pair of washers 60 and 61 and a lock ring 62 are disposed around the shaft 57 to properly position and retain the same with respect to the housing 51. The bearing 58 permits the transfer shaft 57 to be tilted slightly relative to the printer 11 to accommodate engagement with the output shaft 30.

Figure 7:
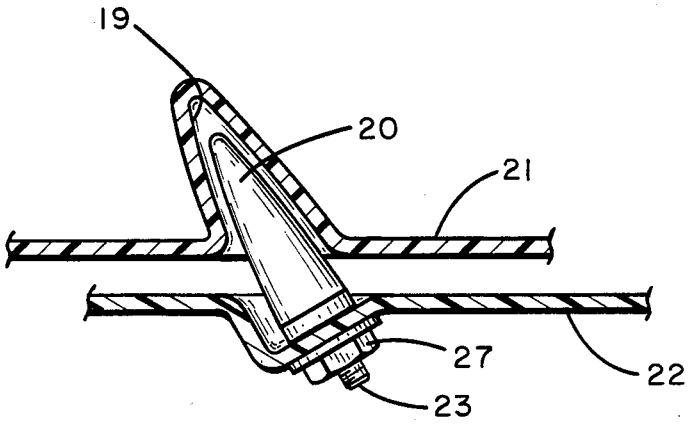
FIG. 7 is a view, partially in section, showing one of the three alignment cavities and corresponding alignment prongs in position for engagement with one another.

The mechanical alignment means comprising the alignment cavities 19 and the alignment prongs 20 are illustrated best in FIGS. 2 and 7. As shown, the prongs 20 extend outwardly from the top surface 22 of the keyboard at an angle which is generally parallel to the angle at which the alignment pins 29, 29 and the alignment prongs 38, 38 extend. The alignment cavities 19 are disposed at a similar angle to receive the prongs 20. In the preferred embodiment, this angle is between about 45° and 75° and preferably about 60°. In the embodiment illustrated, three alignment prongs 20 are provided on the surface 22 and three corresponding alignment cavities 19 are provided in the surface 21, although it is contemplated that any number of such alignment prongs and cavities could be provided. As illustrated in FIG. 7, the alignment prongs 20 are connected with a portion of the surface 22 by a threaded end 23 and a cooperating threaded nut 27.

Having described the structure of the preferred embodiment in detail, the operation can be best understood as follows. In general, the present invention provides a quick and uncomplicated means for interfacing a printer portion with a keyboard portion of a dry lettering apparatus. This permits the purchaser to first acquire a manual printer and then, at a later date, supplement that purchase with the automated keyboard if such a purchase is needed or desired. To interface the two components in accordance with the present invention, the printer is merely placed onto the keyboard so that the alignment prongs 20 and corresponding alignment cavities 19 are generally aligned. Because of the tapered nature of the prongs 20 and the cavities 19, the printer 11 will be guided into proper alignment with the keyboard as a result of these tapered surfaces. During the alignment and interface movement, the tapered alignment prongs 38 are guided into the alignment cavities 39 in the electrical interface assembly and the tapered alignment pins 20 are guided into the alignment openings 31 in the motor interface assembly. Because at least one of the two mating interface points in each of the electrical and motor interface means is adapted for limited or floating movement, manufacturing tolerances are accommodated.

It should be noted that in the preferred embodiment, all of the interface and alignment prongs and pins, including the alignment prongs 38, 38, the alignment pins 29, 29 and the alignment prongs 20, extend outwardly from their respective supporting surfaces in a direction generally parallel to one another and also in a direction generally parallel to their receiving cavities. After the printer has been placed on the keyboard and interfaced in the manner described above, the lettering system is ready for operation merely by inserting an appropriate plug into an electrical outlet and activating the system.

Although the description of the preferred embodiment has been quite specific, it is contemplated that various changes and modifications could be made without deviating from the spirit of the present invention. Accordingly, it is intended that the scope of the present invention be dictated by the appended claims, rather than by the description of the preferred embodiment.

We claim:

1. A lettering apparatus comprising:

a data input housing having a character font motor and a data input means embodied therein and a top interface and support surface, said character font motor including a shaft portion extending outwardly from said font motor and above said top interface and support surface;

a printer having a rotatable character font, a bottom interface and support surface for interfacing engagement with said top interface and support surface of said data input housing and means for connecting said printer to an electrical outlet, said printer being free of any character font motor, said printer further being manually operable independently and said character font being manually rotatable of said data input means and without electrical connection with said data input means; and quick interface means facilitating quick and selective interfacing between said printer and said data input means and housing to automate said printer, said interface means including:

electrical interface means for providing said data input means with a power source and for providing control interface between said data input means and said printer, said electrical interface means having a first electrical interface element connected with said bottom interface and support surface of said printer and a second electrical interface element connected with said top interface and support surface of said data input housing, one of said first and second electrical interface elements including a protruding electrical alignment member, and the other including an electrical alignment cavity for engagement by said protruding electrical alignment member, one of said protruding electrical alignment member or electrical alignment cavity being tapered and one of said first or second electrical interface members and its included protruding electrical alignment member or electrical alignment cavity being adapted for limited movement in a plane substantially perpendicular to said protruding electrical alignment member for the purpose of accommodating limited misalignment between said data input housing and said printer; and font motor interface means for operatively connecting the character font motor of said data input housing with the rotatable character font of said printer, said font motor interface means having a first font motor interface element connected with said bottom interface and support surface of said printer and a second font motor interface element connected with said top interface and support surface of said data input housing, one of said first and second font motor interface elements including a protruding font motor alignment member extending generally parallel to said protruding electrical alignment member and the other including a font motor alignment cavity for engagement by said font motor alignment member, one of said protruding font motor alignment member or font motor alignment cavity being tapered and one of said first or second font motor interface members and its included protruding font motor alignment member or font motor alignment cavity being adapted for limited movement in a plane substantially perpendicular to said protruding font motor alignment member for the purpose of accommodating limited misalignment between said data input housing and said printer, whereby said first and second electrical interface elements and said first and second font motor interface elements are respectively engaged by placing said bottom interface and support surface of said printer into aligned engagement with said top interface and support surface of said data input means.

2. The lettering apparatus of claim 1 wherein said interface means further includes a plurality of alignment prongs connected with and extending outwardly form one of said top and bottom surfaces and a plurality of alignment cavities formed in the other of said top and bottom surfaces for engagement by said alignment prongs.

3. The lettering apparatus of claim 2 wherein said plurality of alignment prongs extend outwardly from said top surface and said plurality of alignment cavities are formed in said bottom surface.

4. The lettering apparatus of claim 1 wherein said protruding electrical alignment member and said protruding font motor alignment member are tapered toward their outer ends to facilitate engagement with said electrical alignment cavity and said font motor alignment cavity, respectively.

5. The lettering apparatus of claim 1 wherein said first electrical interface element comprises said protruding electrical alignment member and said first font motor interface element comprises said font motor alignment cavity.

6. The lettering apparatus of claim 5 wherein said protruding electrical alignment member and said protruding font motor alignment member are tapered toward their outer ends to facilitate engagement with said electrical alignment cavity and said font motor alignment cavity, respectively.

7. The lettering apparatus of claim 6 wherein said interface means further includes a plurality of alignment prongs connected with and extending outwardly from one of said top and bottom surfaces and a plurality of alignment cavities formed in the other of said top and bottom surfaces for engagement by said alignment prongs.

8. The lettering apparatus of claim 1 wherein said character font motor includes a font motor shaft extending outwardly from said top surface and said printer includes a font motor transfer shaft for engagement by said font motor shaft.

9. The lettering apparatus of claim 8 including means for mounting said font motor transfer shaft for limited tilting movement relative to said printer.

10. The lettering apparatus of claim 9 wherein said font motor shaft includes a protruding tab and said font motor transfer shaft includes means for engaging said protruding tab so that rotational movement of said font motor shaft will result in corresponding rotational movement of said font motor transfer shaft.

11. The lettering apparatus of claim 8 wherein said protruding font motor alignment member, said protruding electrical alignment member and said font motor shaft are generally parallel to one another when said printer is interfaced with said data input means.

12. The lettering apparatus of claim 1 wherein said protruding electrical alignment member and said protruding font motor alignment member extend outwardly from their respective surfaces to which they are connected at an angle of betwen about 45° and 75°.

13. The lettering apparatus of claim 12 wherein said angle is about 60°.

14. The lettering apparatus of claim 1 wherein said data input means is a keyboard.

* * * * *